United States Patent [19]

Shirasugi

[11] Patent Number: 5,063,414

[45] Date of Patent: Nov. 5, 1991

[54] COPIER ALLOWING SUCCESSIVE COPYING OPERATIONS WHILE AVOIDING CERTAIN WAITING PERIOD

[75] Inventor: Kouji Shirasugi, Satte, Japan

[73] Assignee: Ricoh Company, Ltd., Japan

[21] Appl. No.: 451,232

[22] Filed: Dec. 15, 1989

[30] Foreign Application Priority Data

Dec. 28, 1988 [JP] Japan ..... 63-329066

[51] Int. Cl.[5] ..... G03G 21/00

[52] U.S. Cl. ..... 355/296; 355/208; 355/256; 355/297; 355/307

[58] Field of Search ..... 355/206, 208, 209, 256, 355/313, 307, 299, 203, 314, 297, 296

[56] References Cited

U.S. PATENT DOCUMENTS

| | | | |
|---|---|---|---|
| Re. 28,568 | 10/1975 | Saito et al. | 355/307 |
| 4,551,009 | 11/1985 | Shigemura et al. | 355/299 |
| 4,678,316 | 7/1987 | Abuyama | 355/314 |
| 4,745,436 | 5/1988 | Matsuura | 355/206 |
| 4,789,432 | 12/1988 | Goodnow et al. | 355/299 X |
| 4,989,048 | 1/1991 | Arai et al. | 355/299 |

FOREIGN PATENT DOCUMENTS

| | | | |
|---|---|---|---|
| 0127776 | 6/1987 | Japan | 355/245 |

*Primary Examiner*—A. T. Grimley
*Assistant Examiner*—J. E. Barlow, Jr.
*Attorney, Agent, or Firm*—Mason, Fenwick & Lawrence

[57] ABSTRACT

A semimoist process copier for electrostatically forming a latent image on a photoconductive element and developing it by a liquid developer. When the temperature of the liquid developer or that of the photoconductive drum is lower than a predetermined temperature, the state of the copier just after the end of the previous copying operation is maintained. A person intending to operate the copier for a subsequent copying operation is capable of doing so immediately. The elimination of a waiting period after a drum cleaning operation is performed is achieved by allowing a drum cleaning blade to remain in contact with the drum when the temperature of the liquid developer or the drum is below a reference temperature. In this manner, when the drum or developer temperature is below the reference temperature, no waiting period is experienced by the user on subsequent attempts to copy.

3 Claims, 4 Drawing Sheets

COPIER ALLOWING SUCCESSIVE COPYING OPERATIONS WHILE AVOIDING CERTAIN WAITING PERIOD

BACKGROUND OF THE INVENTION

The present invention relates to a semimoist process copier which electrostatically forms a latent image on a photoconductive element and develops it by a liquid developer and, more particularly, to a semimoist process copier capable of starting on a copying operation immediately and thereby reducing a waiting time.

A semimoist process copier includes a cleaning blade made of rubber or similar elastic material for cleaning the surface of a photoconductive element after the transfer of a developed image from a photoconductive element to a paper sheet. Specifically, the cleaning blade is pressed against the photoconductive element to remove a remaining liquid developer off the photoconductive element. If the cleaning blade is pressed against the photoconductive element at all times, the former is apt to deform or otherwise damage the latter. In the light of this, it is a common practice to release the cleaning blade from the photoconductive element on the lapse of a predetermined period of time after a copying operation has been ended. Generally, the release of the cleaning blade from the photoconductive element is effected in response to the switchover of the copier from a copy mode in which it is ready to operate to either one of a power off mode and a preheat mode. In the power off mode the power source of the copier is turned off, while in the preheat mode only the display section on the operation board of the copier is turned off. Such switchover of operating mode is adopted for a power saving purpose also. In practice, the switchover occurs automatically when 1 minute or 15 minutes, for example, expires since the end of a copying operation. When the power source is turned on again or a preheat mode cancel key is pressed in order to resume the copying operation while the power off mode or the preheat mode is set up, the cleaning blade is caused into pressing contact with the photoconductive element. Then, the cleaning blade precleans the photoconductive element to remove contamination which occurred when the cleaning blade was released at the end of the previous copying operation. Specifically, the photoconductive element is rotated with the liquid developer being fed from a cleaning unit onto the photoconductive element for a predetermined period of time.

As stated above, the prior art semimoist process copier cannot resume a copying operation on the lapse of a predetermined period of time after the previous operation, unless one turns on the power source again, cancels the preheat mode or otherwise triggers the copier. Moreover, after such a triggering manipulation, one has to simply wait until the photoconductive element has been throughly precleaned, i.e., one cannot operate the machine until a precleaning time expires. Therefore, it may occur that the operator regards the copier as having failed and therby gives up using it due to the turn-off of the power source or that of the display section.

SUMMARY OF THE INVENTION

It is therefore an object of the present invention to provide a semimoist process copier which eliminates the drawbacks particular to the prior art as discussed above.

It is another object of the present invention to provide a semimoist process copier which under a certain predetermined condition is capable of starting on a copying operation immediately without any waiting time and by a simple manipulation.

It is another object of the present invention to provide a generally improved semimoist process copier.

In accordance with the present invention, in a semimoist process copier in which an operation mode is switched from a copy mode to either one of a power off mode and a preheat mode on the lapse of a predetermined period of time since the end of a copying operation, and a cleaning blade of a cleaning unit is released from a photoconductive element in response to the switchover of the operation mode, a temperature sensor is responsive to a temperature of a liquid developer which is fed to the photoconductive drum and the cleaning unit. A controller continues the copy mode when the temperature sensed by the temperature sensor is lower that a predetermined temperature.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
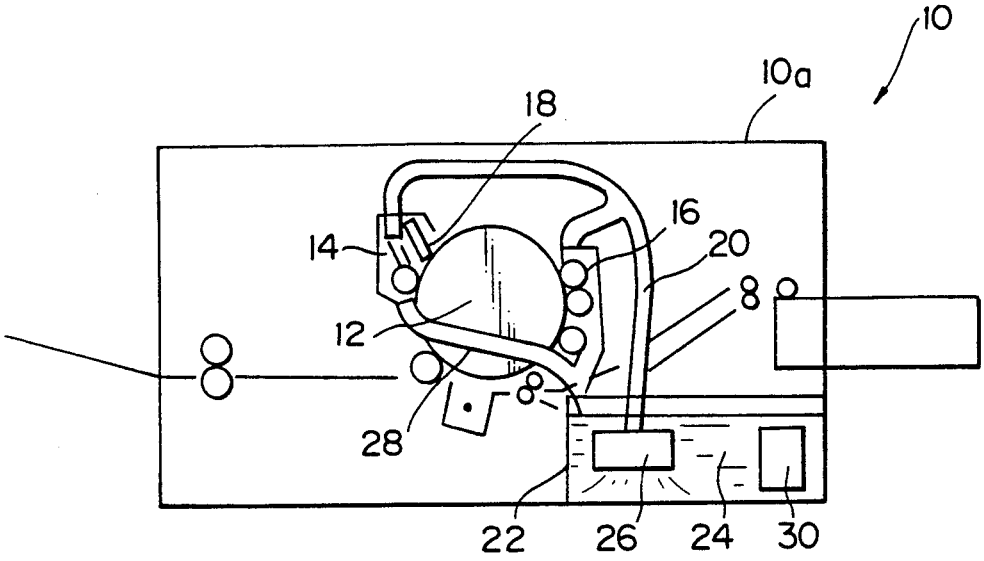
FIG. 1 is a schematic view of a semimoist process copier embodying the present invention.

Referring to FIG. 1 of the drawings, a semimoist process copier embodying the present invention is shown schematically and generally designated by the reference numeral 10. As shown, the copier 10 has a body 10*a* and a photoconductive element in the form of a drum 12 which is disposed in the body 10*a*. A cleaning unit 14 and a developing unit 16 are arranged around the drum 12. The cleaning unit 14 has a flexible cleaning blade 18. The cleaning unit 14 and developing unit 16 are communicated to a developer tank 22 by a tubing 20. A pump motor 26 pumps a liquid developer 24 from the developer tank 22 to the cleaning unit 14 and developing unit 16. The pump motor 26 is controlled to start rotating when a copying operation begins. Therefore, while a copying operation is under way, the liquid developer 24 is continuously fed to the developing unit 16 and cleaning unit 14 via the tubing 20 by the pump motor 26. Another tubing 28 is provided for returning the liquid developer 24 from the units 14 and 16 to the tank 22. In this configuration, the liquid developer 24 is returned to the developer tank 22 after contacting the developer 12 in both the developing unit 16 and the cleaning 14. This, coupled with the fact that the liquid developer 24 has extremely high thermal conductivity, allows a temperature sensor 30 disposed in the developer tank 22 to serve two different functions, i.e. a function of sensing the temperature of the developer as originally intended and a function of sensing the temperature of the drum 12. In the illustrative embodiment, the temperature sensor 30 is implemented as a thermistor.

Figure 2:
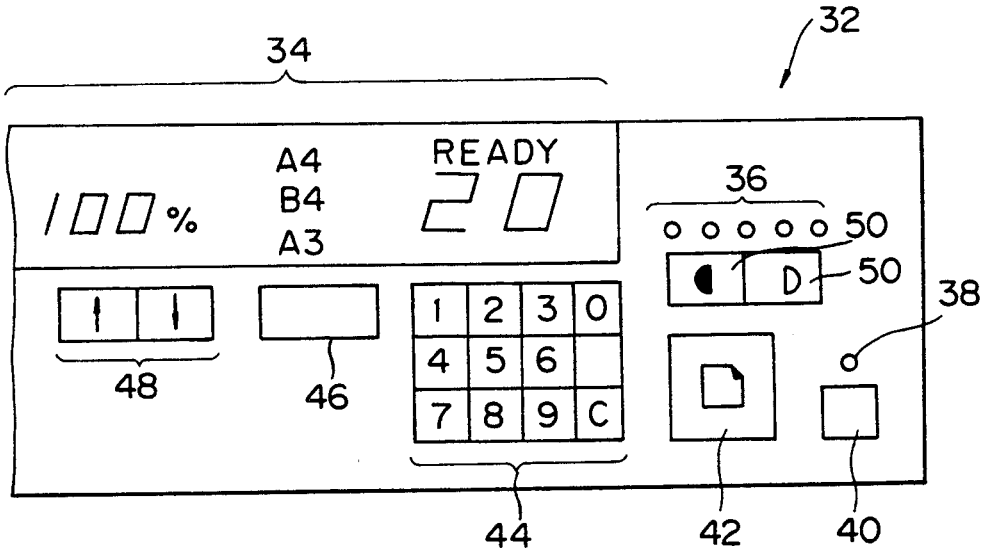
FIG. 2 is a fragmentary view of an operation board provided on the copier shown in FIG. 1.

Referring to FIG. 2, the copier 10 has an operation board 32 which includes a display section 34 for displaying a zoom magnification, a paper cassette selected, the number of copies, etc. The operation board 32 also includes LEDs (Light emitting diodes) 36 for indicating an amount of exposure selected, LEDs 38 for indicating a preheat mode, a preheat mode key 40 for cancelling the previously stated preheat mode, a print key 42, numeral keys 44, a cassette select key 46, a magnification select key 48, and an exposure amount select key 50.

Figure 3:
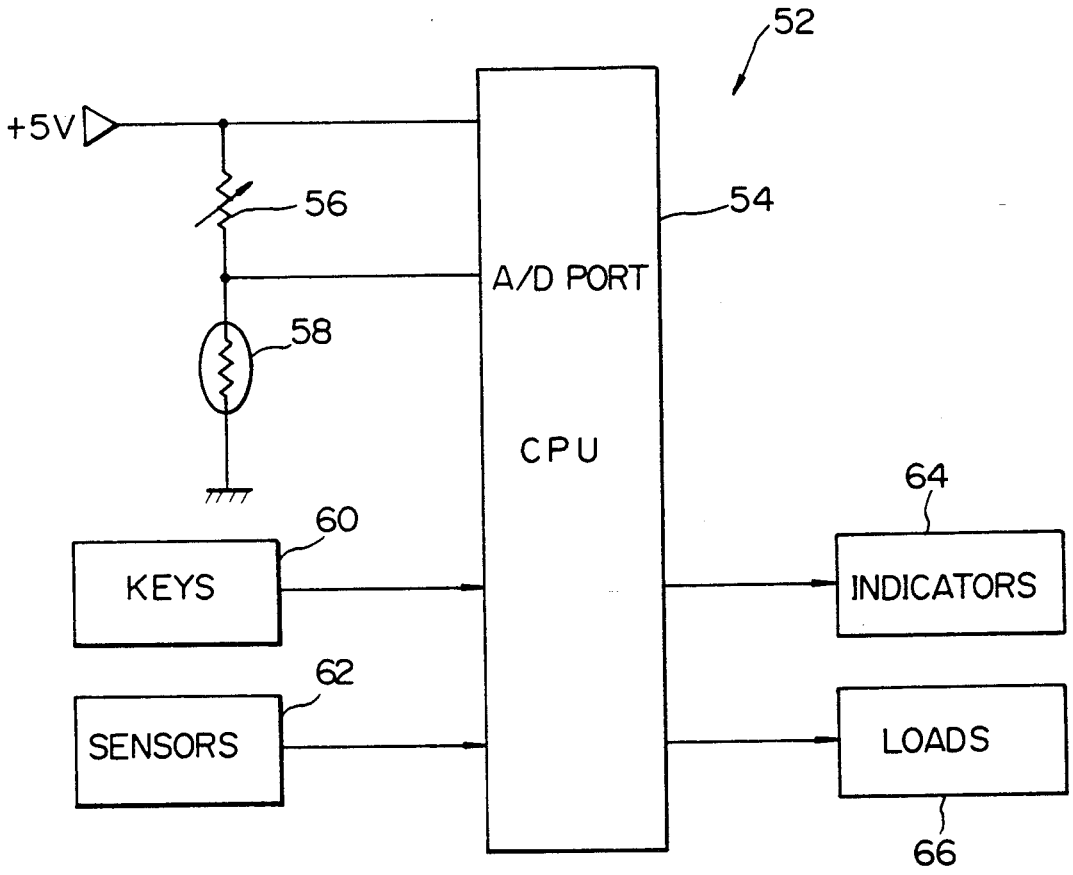
FIG. 3 is a schematic block diagram representative of a control system installed in the copier of FIG. 1.

FIG. 3 is a schematic block diagram showing a control system 52 which is installed in the copier 10. As shown, the control system 52 has a controller in the form of a CPU (Central Processing Unit) 54. The CPU 54 has an A/D (Analog/Digital) port. A variable resistor 56 and a temperature sensor implemented as a thermistor 58 divide a power source voltage of 5 volts and applies the resulting voltage to the A/D port of the CPU 54. The A/D resolution is 256. Hence, if the variable resistor 56 is adjusted such that a voltage of 2.5 volts is applied to the A/D port when the developer temperature is 40 degrees centigrade, a controller 54 can determine whether or not the developer temperature is higher than 40 degrees centigrade with respect to digital data of 128. Various keys 60 and various sensors 62 are interconnected to the CPU 54, while the CPU 54 is interconnected to various indicators 64 and various loads 66.

Specific Operations of the control controller 54 will be described with reference to FIGS. 4 to 6.

Figure 4:
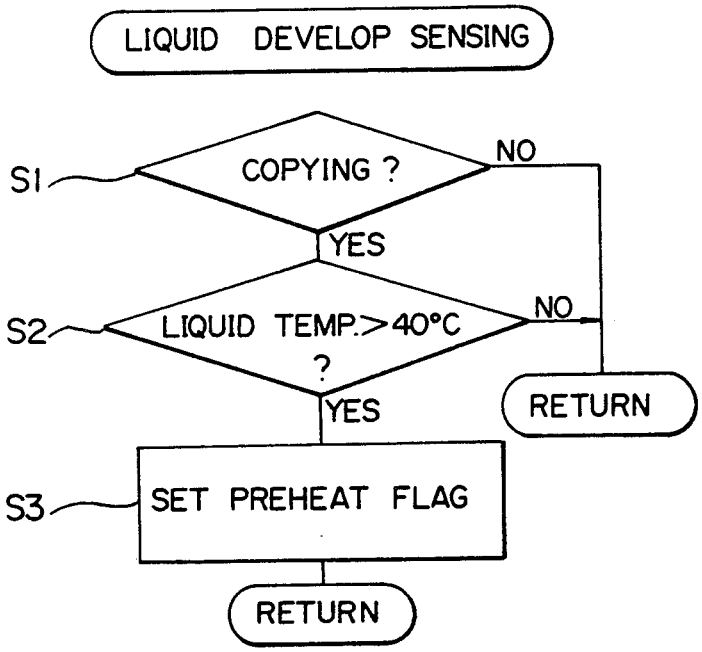
FIGS. 4 to 6 are flowcharts demonstrating specific operations of the control system shown in FIG. 3.
Figure 5:
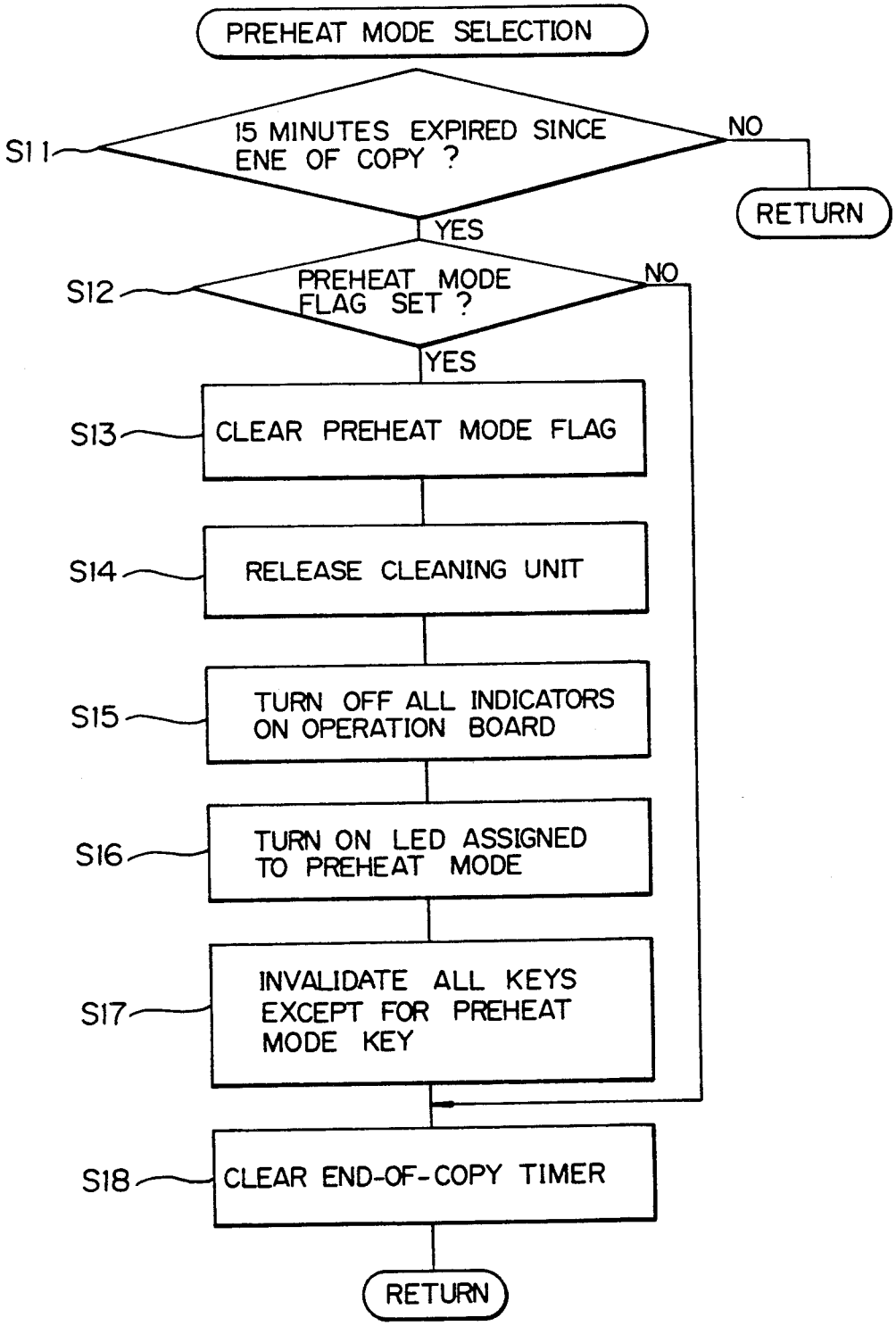

FIG. 4 shows a developer temperature sensing routine. Temperature data produced by the temperature sensor 58 is collected while the developer 24 is circulated (YES, step S1). When the developer temperature becomes higher than 40 degrees centigrade (YES, step S2), a preheat mode flag is set (step S3). This is followed by a preheat mode selecting routine shown in FIG. 5. Specifically, on the lapse of 15 minutes since the end of a copying operation (YES, step S11), whether or not the preheat mode flag is set is determined (step S12). If the answer of the step S12 is YES, steps S13 to S17 are executed for clearing the preheat mode flag, releasing the cleaning unit, turning off all the indicators on the operation board 32, turning on the LED for indicating the preheat mode, invalidating all the keys except for the preheat mode key. It has been customary to simply execute the processing which is associated with the condition wherein the preheat mode flag is set, as discussed earlier. This is undesirable because, whenever more than 15 minutes expires since the end of a copying operation, a person intending to operate the copier for another copying operation has to press the preheat mode key 40 to restore the copier to its standby condition. In the illustrative embodiment, if the temperature of the developer 24 is lower than 30 degrees centigrade, only an end-of-copy timer is cleared and no other processing is executed (step S18, FIG. 5). Therefore, the next copying operation can be effected immediately with no regard to the period of time which has expired since the end of the previous copying operation. It has been confirmed that so long as the temperature of the drum 12 or that of the developer 24 is lower than 40 degrees centigrade, the drum 12 is free from deformations or scratches even when the cleaning blade 18 is constantly held in contact with the drum 12.

Figure 6:
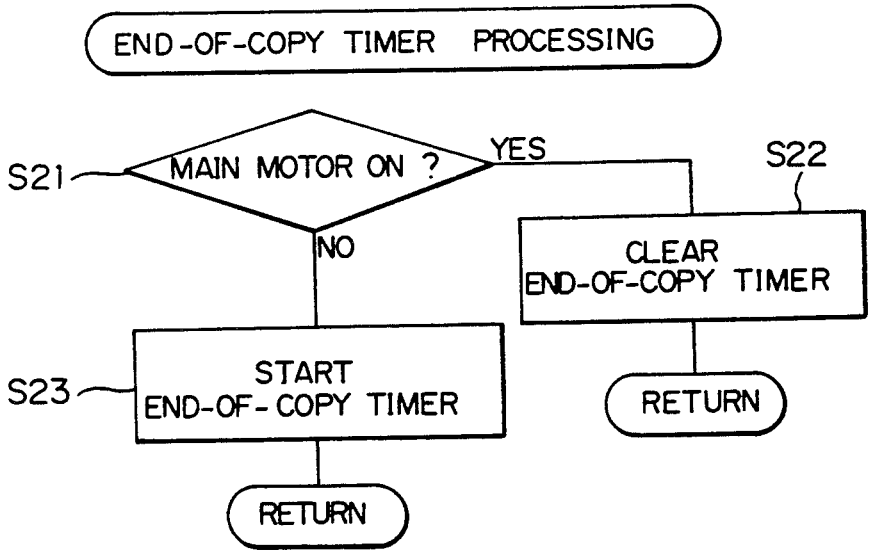

As shown in FIG. 6, the end-of-copy timer is cleared (step S22) while a main motor (not shown) is rotating (YES, step S21) and is started (step S23) on the deenergization of the main motor (NO, step S21). It is to be noted that the words "while a copying operation is under way" mentioned previously refers to a condition wherein the main motor is rotating after the turn-on of the print key 42.

In summary, it will be seen that the present invention provides a semimoist process copier which is operable without a waiting time when the temperature of a photoconductive element or that of a developer is lower than a predetermined temperature, so long as a main switch of the copier is not intentionally turned off.

Various modifications will become possible for those skilled in the art after receiving the teachings of the present disclosure without departing from the scope thereof.

What is claimed is:

1. A copier in which an operation mode is switched from a copy mode to either a power off mode or a preheat mode on the lapse of a predetermined period of time after a copying operation, the copier comprising:

a photoconductive element;

a cleaning unit including a cleaning structure, the cleaning structure being released from the photoconductive element in response to switchover of the operation mode;

temperature sensing means responsive to a temperature of a liquid developer which is fed to the photoconductive element and the cleaning unit; and control means, responsive to the temperature sensed by the temperature sensing means, for continuing the copy mode to avoid a waiting period before a subsequent copying operation when the temperature sensed by the temperature sensing means is lower than a predetermined temperature.

2. A copier as claimed in claim 1, wherein:

the control means inhibits the switchover of the operation mode when the sensed temperature is lower than the predetermined temperature, so as to avoid the waiting period before the subsequent copying operation.

3. A copier as claimed in claim 1, wherein:

when the copier is in the power off mode or the preheat mode when the sensed temperature is lower than the predetermined temperature, the control means switches the power off mode or preheat mode to copy mode so as to avoid the waiting period before the subsequent copying operation.

* * * * *